United States Patent [19]

Knappworst et al.

[11] 4,245,557

[45] Jan. 20, 1981

[54] PROJECTILE, ESPECIALLY FOR HAND FIREARMS AND AUTOMATIC PISTOLS

[75] Inventors: Jürgen Knappworst, Fürth; Heinz Gawlick, Vagen; Helmut Brieger, Fürth, all of Fed. Rep. of Germany

[73] Assignee: Dynamit Nobel AG, Fed. Rep. of Germany

[21] Appl. No.: 702,898

[22] Filed: Jul. 6, 1976

[30] Foreign Application Priority Data

Jul. 5, 1975 [DE] Fed. Rep. of Germany ..... 2530155

[51] Int. Cl.[3] ..... F42B 11/10

[52] U.S. Cl. ..... 102/91; 102/92.3

[58] Field of Search ..... 102/91, 92.2, 92.3, 102/92.4

[56] References Cited

U.S. PATENT DOCUMENTS

| | | | |
|---|---|---|---|
| 355,653 | 1/1887 | Loyd | 102/92.4 |
| 1,023,469 | 4/1912 | Haslett | 102/91 |
| 1,063,748 | 6/1913 | Starkweather | 102/91 |
| 1,070,457 | 8/1913 | Gully | 102/91 |
| 1,080,974 | 12/1913 | Johnson | 102/91 |
| 1,135,357 | 4/1915 | Clyne | 102/91 |
| 1,493,614 | 5/1924 | Dickerman | 102/91 |

FOREIGN PATENT DOCUMENTS

| | | | |
|---|---|---|---|
| 22505 | of 1906 | United Kingdom | 102/91 |

*Primary Examiner*—Charles T. Jordan

*Attorney, Agent, or Firm*—Craig & Antonelli

[57] ABSTRACT

A projectile, especially for hand firearms and automatic pistols, including a core member formed of a first material and provided with a blind bore extending in the forward direction into an outwardly inclined truncated cone surface indentation in the core member. A projectile insert member formed of a second material which is more difficult to deform than the first material, contacts the core member along the outwardly inclined truncated cone surface thereof and is provided with a lug portion extending into said blind bore of the core member for detachably joining said insert member and said core member. A jacket member encompasses the rear portion of said core member and extends forwardly at least up to a zone of the core member surrounding said blind bore. The jacket member has a front edge portion which terminates at a spacing from the forward edge portion of the core member so as to provide an unjacketed strip portion of the core member thereat.

17 Claims, 4 Drawing Figures

PROJECTILE, ESPECIALLY FOR HAND FIREARMS AND AUTOMATIC PISTOLS

The present invention relates to a projectile, especially for hand firearms and automatic pistols.

Special requirements must be met by projectiles suitable particularly for combating lawbreakers by the police. These projectiles are to exhibit, even at varying firing distances, a satisfactory firing effect, i.e. a high energy transmission to the target, with a minimum degree of danger to uninvolved persons located behind and/or in close proximity of the lawbreaker. At the same time, however, these projectiles must also be capable of penetrating hard targets, such as automobile bodies, for example, and then still are to have sufficient energy for rendering the automobile passenger immediately powerless. The projectiles are to be usable in a maximally universal fashion for police deployment and are to ensure a flawless, optionally also automatic firearm function in all types of handguns, automatic pistols, long firearms, etc. which are in use. Additionally, the projectiles should have a satisfactory firing efficiency.

The solid-jacket bullets nowadays employed by police for the combating of lawbreakers have a relatively minor stopping power. The lawbreaker, when hit, is frequently still able to act and fight for a period of time sufficient for him to maim or kill his adversaries, hostages, or outsiders with his firearm. Another disadvantage inherent in the heretofore employed police bullets is that a projectile, after penetrating a body part, still has such a high residual energy it can still hurt or even kill innocent persons located behind the hit lawbreaker.

Projectiles which have no deadly effect are suggested, for example, in German Utility Model No. 7,321,752 and DOS [German Unexamined Laid-Open Application] No. 2,322,505 and may be utilized for combating lawbreakers. Such projectiles transmit their energy in the target over a very large cross-sectional area and do not have any essential penetrating effect in the body. Thus, the energy transmission and firing power of these projectiles are very minor. Due to their very weak penetrating effect, they furthermore are incapable of passing through hard targets. Thus, they are unsuitable for universal use by the police.

The principle of conventional hunting rifle projectiles which comprise, within a case, one or optionally also two projectile cores of lead and which are also provided with a forward bullet insert of plastic, bronze or gun metal, or the like, does not prove to be especially advantageous for use in handguns and automatic pistols, either. The projectile insert is pressed with a lug into a cylindrical blind bore of the lead core and contacts the core of the projectile along a truncated cone surface which—as seen in the flying direction—is inclined toward the outside. The projectile case extends toward the front up to the bullet insert so that the forward end face of the case contacts the truncated cone surface of the bullet insert, i.e. the bullet inset terminates together with the front edge of the case. Upon impingement in the target, the encased projectile core moves toward the front over the truncated cone surface of the bullet insert and is expanded and optionally disintegrated in its forward zone during this process. However, if such projectiles are utilized in firearms having lower bullet velocities, such as pistols or revolvers, for example, then at most a very minor expansion is obtained when the bullet penetrates into the target, and thus such a low amount of energy is transmitted to the targer that sufficient energy transmission is not achieved.

A projectile universally usable especially for police deployment against lawbreakers should meet the following criteria:

(1) Flawless functioning of the firearm in case of all types of weapons, including self-loading firearms which can be utilized in the corresponding caliber.

(2) Satisfactory firing power or efficiency to ensure a sufficiently high hit probability.

(3) Satisfactory bullet effect a varying firing distances, i.e. high energy transmission of the projectile to the target, to be able to render the lawbreaker unfit to fight and act immediately, even without a deadly effect.

(4) Satisfactory penetrating power comparable to that of the conventional solid-jacket projectiles, with respect to hard targets, such as, for example, automobile bodies or house doors at varying firing distances.

(5) Minor danger to the surroundings behind the target by the projectile.

It is therefore an object of the present invention to provide a projectile of the type mentioned in the foregoing so that the disadvantages of the conventional projectiles are avoided and, in particular, the above-recited criteria are fulfilled as well.

In accordance with the present invention, a projectile is provided with a jacketed projectile core and a forward bullet insert, which is more difficult to deform than the bullet core, the bullet insert and the bullet core contacting each other along an outwardly inclined—as seen in the flying direction—truncated cone surface and being joined together by means of a lug extending into a blind bore of the bullet core. The jacket encompassing the rear of the projectile extends toward the front up to at least the zone of the bullet core provided with the blind bore, but terminates with its front edge at a spacing from the forward outermost annular edge of the bullet core. In this connection, the bullet insert is fashioned so that it covers completely the forward truncated-cone-like opening of the bullet core, and that the projectile of this invention has preferably the external shape and dimensions of the conventional solid-jacket projectiles. This ensures the flawless funtioning of the firearm as well as the high firing efficiency.

On the basis of a feature according to this invention that the strip-shaped zone of the bullet core between the forward end of the case and the bullet insert is uncovered, i.e. not encased, a good target-ballistic effect is obtained on soft targets. The extremely uniform projectile deformation initiated by way of the bullet insert, taking place with an increasing cross-sectional expansion of the projectile, results in an optimum energy transmission to the target body, whereby the lawbreaker becomes immediately unfit to act and/or fight.

As was found under practical conditions, the projectile of the present invention, however, has additionally satisfactory penetration power with regard to hard targets, comparable to that of conventional, solid-jacket projectiles. After penetrating soft or hard target media, the projectile represents hardly any danger any more for the rear area, due to its great velocity and energy losses. The tendency to ricochet is eliminated, since the projectile is deformed via the bullet insert already at a very small angle of impingement and thus rapidly loses velocity and energy due to the unfavorable drag coefficient $C_w$.

An advantageous further development of the projectile according to the invention is that the jacket extends with its front edge into the bullet core zone comprising the truncated cone surface. This projectile optimally satisfies the customary requirements in universal police usage against lawbreakers. By the extension of the projectile case toward the front, but still leaving a narrow annular strip of the projectile core without a case, a disintegration of the forward part of the projectile core is avoided with certainty without undesirably lowering thereby the energy transmission and/or increasing the penetrating power.

With a view toward a maximally favorable behavior of the projectile within the firearm, during its flight toward the target, and upon penetration into the target, a projectile structure wherein the end face of the front edge of the jacket contacts a continuous shoulder of the bullet core in such a way that the external jacket surface passes over without interruption into the external bullet core surface which is not covered by the jacket proves to be advantageous.

Another advantageous embodiment of the projectile according to the present invention provides that the jacket and the bullet core are pressed in their forward zone against the lug of the bullet insert, which lug is conically widened toward the rear. In this projectile, the blind bore is likewise made to conically flare toward the rear—at least in its zone encompassing the lug—so that the bullet insert is connected via its lug with the projectile core not only by a friction fit but also by a shape-mating connection and thus in a particularly fire manner. At the same time, the advantage is attained by the conical configuration of the lug that the mushrooming of the projectile when impinging upon and penetrating into the target is enhanced, since the sliding of the more readily deformable projectile core along the conical lug—as seen in the flying direction—toward the front is facilitated.

The length of the jacket likewise affects the mushrooming process. The jacket is to extend according to the present invention toward the front at least up into the region of the core portion provided with the blind bore, preferably up into the zone of the core portion with the truncated cone surface, particularly up to approximately the middle thereof, but is to terminate with its forward rim at a spacing from the forward, outermost annular edge of the projectile core. The axial length of the annular strip of the bullet core, which thus is not covered by the jacket, is at least about 1 mm. It is preferably the larger the more difficult it is to attain the desired projectile deformation per se.

It is advantageous to provide an additional deformation space between the rear end of the lug and the bottom of the blind bore. The free deformation space contributes toward reaching a uniform, controllable compression and mushrooming of the bullet when impinging on and penetrating into the target body. The free deformation space, however, likewise facilitates the manufacture of the projectile of this invention. For example, the projectile insert can be pressed into the prefabricated, partially jacketed projectile core which has a blind bore. For the purpose of facilitating the introduction of the lug into the blind bore, the rear end of the lug can be chamfered.

To support the mushrooming process, it is advantageous to provide the jacket in its front section with longitudinally extending deformation grooves, notches, or the like distributed at uniform intervals along the circumference. The length of such deformation grooves, notches, or the like is preferably no greater than half the length of the bullet jacket.

Preferably, a tough, not brittle metal is utilized for the jacket, especially tombac. Brittle metals are less well suited, since it is undesirable to encounter any broken away jacket fragments during the mushrooming process.

For the core of the projectile, a material of high specific gravity is preferably employed for the purpose of attaining maximally high energy release during impingement in the target. The material, however, must simultaneously also be so soft that the relatively difficult to deform bullet insert can penetrate into the core of the projectile during the instant of the impingement of the projectile on the target, and thus deform this core. Examples for suitable materials are: lead, lead alloys, lead-weighted, plastically deformable synthetic resins, or the like.

The bullet insert of the projectile of the present invention protects the uncovered opening of the bullet core from damage and deformations, starting with the manual loading operation into the magazine or drum of the firearm, as well as the impact stress to which the cartridges are subjected which are in the clip of the firearm during firing, up to the actual cartridge feeding step from the magazine into the cartridge chamber. Cartridges having too soft a tip can incur such strong projectile tip deformation when fired from various types of firearms that cartridge feeding jams occur and the firearms then can no longer be employed without time-consuming manipulations. Also, for attaining a uniform target-ballistic projectile action, it is necessary for the projectile tip not to be deformed either during the loading of the firearm or during firing. For this reason, a maximally impact-resistant material, but one that is, at the same time, not too hard, is utilized which is harder to deform than the bullet core. Suitable for purposes of this invention are, for example, soft steel, brass, impact-resistant plastics, e.g. polystyrene, or the like. In general, a material is used having a specific gravity lower than that of the material for the bullet core. Optionally, if a shift of the center of gravity is desired, it is also possible, however, to utilize for the bullet insert a material of a higher specific gravity, or to use such material as a component therein. For example, the bullet insert can consist of a brass casing, the inside of which is filled with a material of a high specific gravity, e.g. lead. The projectile insert is preferably a solid body, although it can also basically be a hollow element or a partially hollow component, as long as the requirement is met that it is harder to deform than the bullet core.

The partially encased projectile core of the projectile of this invention, as well as the projectile insert are adapted to each other with regard to their external dimensions, so that the two parts complement each other to the conventional external configuration of a solid-jacket projectile. The part adjoining the truncated cone of the bullet insert toward the front constitutes the bullet tip proper and preferably has the shape of a spherical segment. The external surface of the bullet core, which is not encased, passes over preferably without interruption into the outer surface of the projectile insert. The inclination of the outwardly tilted—as seen in the flying direction—truncated cone surfaces of the bullet core and of the bullet insert depends on the caliber of the projectile. In general, the conical angle in the projectiles of this invention is between about 45° and 120°, and this angle is the larger, the larger the bullet caliber.

These and other objects, features and advantages of the present invention will become more apparent when taken in connection with the accompanying drawing, which shows for purposes of illustration only, a single embodiment in accordance with the present invention and wherein.

Figure 1:
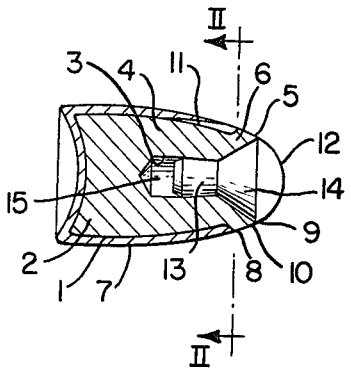
FIG. 1 shows a projectile in accordance with the present invention in a partial longitudinal section.
Figure 2:
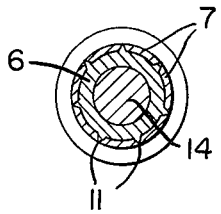
FIG. 2 shows a cross section along line II—II of FIG. 1.

Referring now to the drawing, there is shown in FIG. 1, a projectile including a bullet core 1 having a rear portion 2, a zone 4 surrounding a blind bore 3—as seen in the radial direction—and a zone 6 surrounding a truncated cone surface 5, made from a material lending itself relatively well to deformation, preferably a metal, such as lead, for example with the core being produced, for instance, by embossing. The projectile core 1 is surrounded by a jacket 7 of tombac, for example. The jacket 7 is closed at the rearward end, and extends with its forward edge 8 up into the zone 6 with the truncated cone surface 5, but terminates at a spacing from the forward outermost annular edge 9 of the bullet core 1, so that the latter does not have a jacket in the area of an annular strip portion 10. The bullet core 1 thus projects from the jacket 7 with its front end. The jacket 7 has axial or longitudinal deformation notches 11 emanating from its front edge 8 and uniformly distributed along the circumference, as shown in FIG. 2.

The projectile core 1 is provided with its forward zone 6 with an indentation delimited by the truncated cone surface 5 such that the indentation is in the form of a truncated cone with the cross section of this indentation being widened toward the front. Toward the rear, the indentation passes over in the central region 4 of the bullet core 1 into the blind bore 3 which latter flares conically in the direction toward the rear 2 of the projectile. A bullet insert 12 made of an impact-resistant material which is more difficult to deform than the bullet core 1, e.g. brass, is disposed in this indentation, the bullet insert being shown in an elevational view. The bullet insert 12 is shaped so that it covers the front opening of the bullet core 1 entirely and completely fills the truncated-cone-shaped indentation. The bullet insert is provided with a conical lug 13 which extends into the blind bore 3 of the bullet core 1. Between the rear end of the lug 13 and the bottom of the blind bore 3, a free deformation space 15 is provided. The projectile insert 12 is firmly joined to the bullet core 1 via its conical lug 13 by pressing the bullet jacket 7 and the bullet core 1 thereagainst. The end face of the rim 8 of the bullet jacket 7 is fashioned to be inclined outwardly—as seen in the flying direction—and contacts a correspondingly shaped, continuous shoulder of the bullet core 1 in such a way that the outer surface of the jacket passes over without interruption into the external, unjacketed bullet core annular strip surface portion 10. The diameter of the annular edge 9 of the bullet core 1 is equal to the largest diameter of the bullet insert 12, namely the base diameter of the conical part 14 thereof, contacting the truncated cone surface 5 of the bullet core zone 6. The free outer surface of the bullet insert 12, illustrated in the shape of a spherical segment, passes over without any steps or bends into the uncovered surface of the bullet core 1, namely the annular strip portion 10.

Figure 3:
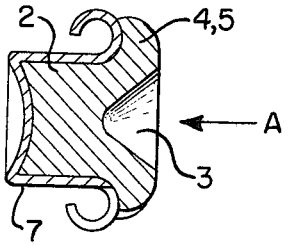
FIG. 3 shows the deformed projectile in a longitudinal section.
Figure 4:
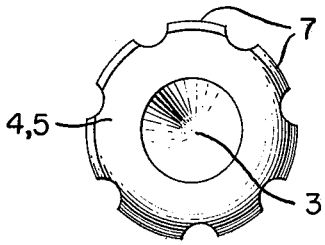
FIG. 4 is a view of this projectile in accordance with arrow A in FIG. 3.

The bullet insert 12 protects the part of the bullet core 1 extending from the jacket 7 from damage and deformations, for example during the loading of the firearm, during transportation and so on. The bullet insert 12 furthermore must fulfill important target-ballistic tasks which will be explained with reference to FIG. 3 and FIG. 4. After impingement on soft or hard targets, the impact-resistant bullet insert 12—as seen relatively—is pressed backwards into the free deformation space 15 of the blind bore 3, in the direction of the rear 2 of the projectile, and thus effects a uniform enlargement of the cross section of the projectile. The material of the bullet core 1 present between the jacket 7 of the bullet and the bullet insert 12 is displaced toward the rear, whereby corresponding forces are exerted on the jacket 7 of the projectile. By way of the deformation notches 11, representing predetermined breaking points, the bullet jacket 7 is torn, and the latter is bent toward the rear in the direction toward the rear or tail of the projectile 2. This process continues such that a very uniform increasing cross-sectional enlargement of the projectile occurs. The bullet insert 12 remains in close connection with the bullet core 1 as long as it can still be guided in the blind bore 3 of the bullet core 1 with its lug 13. Due to the increasing enlargement in cross section, the blind bore 3 is widened, starting with a certain degree of deformation, to such an extent that the bullet insert 12 can no longer be guided and thus is separated from the bullet core 1, without evoking any substantial effects in the target. This condition is illustrated in FIGS. 3 and 4. The degree of deformation of the projectile has now increased, with the aid of the bullet insert 12, to such a degree that a further increase in cross section now takes place in accordance with the velocity of the projectile, the density of the target medium, its wall thickness, etc., over the entire end face of the bullet, as in case of a conventional partially jacketed hollow-tipped projectile.

While we have shown and described only a single embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A projectile for hand firearms and automatic pistols comprising a projectile core member formed of a first material and provided with a blind bore extending in the forward direction of the projectile into an outwardly inclined truncated cone surface indentation in said core member, a projectile insert member formed of a second material which is more difficult to deform than said first material, said insert member including a portion contacting said core member along the outwardly inclined truncated cone surface thereof and a lug portion extending from said contacting portion toward the rear of said core member into said blind bore of said core member for detachably joining said insert member and said core member, a jacket member encompassing the rear portion of said core member and extending forwardly at least up to a zone of said core member surrounding said blind bore, said jacket member having a front edge portion terminating at a spacing from the forward edge portion of said core member so as to provide an unjacketed strip portion of said core member thereat, said jacket member having the front edge portion thereof extending forwardly into a zone of said core member surrounding said truncated zone surface indentation, said core member being formed of a lead-weighted plastically deformable synthetic resin, and said insert member being formed of an impact-resistant plastic.

2. A projectile according to claim 1, wherein said lug portion of said insert member is conically widened toward the rear of said core member, said core member being pressed in the forward zone thereof against said lug portion of said insert member for enabling the detachable joining of said insert member and said core member exclusively by way of the conically widened lug portion.

3. A projectile according to claim 2, wherein the conically widened lug portion of said insert member facilitates the sliding movement of said core member along said lug portion upon at least one of impingement and penetration of the projectile on a target.

4. A projectile according to claim 3, wherein said blind bore is conically widened toward the rear at least in the zone encompassing the conically widened lug portion.

5. A projectile for hand firearms and automatic pistols comprising a projectile core member formed of a first material and provided with a blind bore extending in the forward direction of the projectile into an outwardly inclined truncated cone surface indentation in said core member, a projectile insert member formed of a second material which is more difficult to deform than said first material, said insert member including a portion contacting said core member along the outwardly inclined truncated cone surface thereof and a lug portion extending from said contacting portion toward the rear of said core member into said blind bore of said core member for detachably joining said insert member and said core member, a jacket member encompassing the rear portion of said core member and extending forwardly at least up to a zone of said core member surrounding said blind bore, said jacket member having a front edge portion terminating at a spacing from the forward edge portion of said core member so as to provide an unjacketed strip portion of said core member thereat, said lug portion of said insert member being conically widened toward the rear of said core member, said core member being pressed in the forward zone thereof against said lug portion of said insert member for enabling the detachable joining of said insert member and said core member exclusively by way of the conically widened lug portion.

6. A projectile according to claim 5, wherein an end face of said front edge portion of said jacket member contacts a continuous shoulder portion of said core member in such a manner that the jacket surface of said jacket member passes over without interruption into the external surface of said core member at the unjacketed strip portion thereof.

7. A projectile according to claim 5, wherein said jacket member has the front edge portion thereof extending forwardly into a zone of said core member surrounding said truncated cone surface indentation.

8. A projectile according to claim 5, wherein said core member is an elongated member having a longitudinally extending axis, said blind bore being arranged along the axis of said core member, and said unjacketed strip portion of said core member being an annular strip portion.

9. A projectile according to claim 5, wherein said insert member completely covers said truncated zone surface indentation of said core member, said lug portion of said insert member having the rear edge thereof spaced from the rear end of said blind bore.

10. A projectile according to claim 5, wherein said jacket member is provided at least in the forward portion thereof with longitudinally extending deformation means uniformly distributed about the circumference thereof.

11. A projectile according to claim 10, wherein said deformation means includes at least one of grooves and notches, said deformaton means extending in the forward portion of said jacket member no greater than half the longitudinal extent of said jacket member.

12. A projectile according to claim 5, wherein said core member is formed of a material of one of lead, lead alloy, and lead-weighted plastically deformable synthetic resin, and said insert member is formed of one of soft steel, brass, and an impact-resistant plastic.

13. A projectile according to claim 5, wherein said insert member has the forward portion thereof forming the tip of the projectile in the form of a spherical segment, said unjacketed surface portion of said core member being constructed so as to pass over without interruption into the outer surface of said insert member.

14. A projectile according to claim 5, wherein said insert member causes deformation of said blind bore and said core member in response to impingement upon a target such that said insert member becomes detached from said core member.

15. A projectile according to claim 5, wherein the forward termination of the outwardly inclined truncated cone surface identation in said core member delimits the forward edge of said core member.

16. A projectile according to claim 5, wherein the conically widened lug portion of said insert member facilitates the sliding movement of said core member along said lug portion upon at least one of impingement and penetration of the projectile on a target.

17. A projectile according to claim 16, wherein said blind bore is conically widened toward the rear at least in the zone encompassing the conically widened lug portion.

* * * * *